US011724523B2

(12) United States Patent
Rosdahl, Jr. et al.

(10) Patent No.: US 11,724,523 B2
(45) Date of Patent: Aug. 15, 2023

(54) AIRFLOW CONTROL THROUGH VACUUM PLATEN OF PRINTING SYSTEM BY A MOVABLE DAMPER, AND RELATED DEVICES, SYSTEMS, AND METHODS

(71) Applicant: XEROX CORPORATION, Norwalk, CT (US)

(72) Inventors: Robert E. Rosdahl, Jr., Ontario, NY (US); Richard P. Ficarra, Williamson, NY (US); Robert Ronald Reed, West Henrietta, NY (US); Christine Ann Steurrys, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/217,370

(22) Filed: Mar. 30, 2021

(65) Prior Publication Data

US 2022/0314646 A1 Oct. 6, 2022

(51) Int. Cl.
*B41J 29/38* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 8,388,246 B2 3/2013 Spence et al.
9,796,546 B1 * 10/2017 LeFevre ..... B65H 5/224
9,815,303 B1 11/2017 Herrmann et al.
9,944,094 B1 4/2018 Herrmann et al.
(Continued)

FOREIGN PATENT DOCUMENTS

CN 104044366 A 9/2014
EP 1449668 A1 * 8/2004 ..... B41J 11/0065
(Continued)

OTHER PUBLICATIONS

Co-Pending U.S. Appl. No. 17/217,388, "Airflow Control in a Printing System Using a Movable Baffle, and Related Devices, Systems, and Methods,", filed Mar. 30, 2021.
(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises an ink deposition assembly, a media transport device, and an airflow control system. The ink deposition assembly comprises printheads to deposit a print fluid, such as ink, on print media, such as paper, transported through a deposition region. The media transport device holds the print media against a moving support surface, such as a belt, by vacuum suction through holes in the media transport device and transports the print media though the deposition region. The airflow control system comprises a damper and an actuator configured to move the damper along a cross-process direction. The damper blocks airflow through a subset of the holes along a side of the media transport device, the subset varying based on a position of the damper. The damper is moved to change the subset of the holes blocked by the damper based on a size of the print medium.

20 Claims, 17 Drawing Sheets

(56) References Cited

U.S. PATENT DOCUMENTS

| | | | | |
|---|---|---|---|---|
| 10,688,778 | B2 | 6/2020 | Fromm et al. | |
| 2002/0158937 | A1 | 10/2002 | Pietrzyk et al. | |
| 2010/0208018 | A1 | 8/2010 | Snyder et al. | |
| 2010/0276868 | A1 | 11/2010 | Moore et al. | |
| 2011/0248441 | A1* | 10/2011 | Yamada | B41J 11/06 271/11 |
| 2013/0050375 | A1 | 2/2013 | Ishimori et al. | |
| 2016/0347091 | A1 | 12/2016 | Onuma et al. | |
| 2018/0339529 | A1 | 11/2018 | Zirilli | |
| 2020/0345545 | A1 | 11/2020 | Zhang | |
| 2021/0138803 | A1 | 5/2021 | Lefevre et al. | |

FOREIGN PATENT DOCUMENTS

| | | | |
|---|---|---|---|
| EP | 1449668 | A1 | 8/2004 |
| EP | 1 319 510 | B1 | 9/2009 |
| GB | 2 374 834 | A | 10/2002 |
| JP | 2011098521 | A | 5/2011 |

OTHER PUBLICATIONS

Co-Pending U.S. Appl. No. 17/217,399, "Devices, Systems, and Methods for Controlling Airflow Through Vacuum Platen of Printing System by a Movable Damper,", filed Mar. 30, 2021.

Co-Pending U.S. Appl. No. 17/217,411, "Devices, Systems, and Methods for Controlling Airflow Through Vacuum Platen of Printing System Via Airflow Zones,", filed Mar. 30, 2021.

Co-Pending U.S. Appl. No. 17/217,432, "Controlling Airflow Through Vacuum Platen of Printing System by a Movable Damper, and Related Devices, Systems, and Methods,", filed Mar. 30, 2021.

Co-Pending U.S. Appl. No. 17/217,448, "Devices, Systems, and Methods for Controlling Airflow Through Vacuum Platen of Printing System by Rotating Valve,", filed Mar. 30, 2021.

Co-Pending U.S. Appl. No. 17/217,466, "Airflow Control in a Printing System, and Related Devices, Systems, and Methods,", filed Mar. 30, 2021.

Cross-cited U.S. Appl. No. 17/217,399, Office Action dated Jun. 9, 2022.

* cited by examiner

AIRFLOW CONTROL THROUGH VACUUM PLATEN OF PRINTING SYSTEM BY A MOVABLE DAMPER, AND RELATED DEVICES, SYSTEMS, AND METHODS

FIELD

Aspects of this disclosure relate generally to inkjet printing, and more specifically to inkjet printing systems having a media transport device utilizing vacuum suction to hold and transport print media. Related devices, systems, and methods also are disclosed.

INTRODUCTION

In some applications, inkjet printing systems use an ink deposition assembly with one or more printheads, and a media transport device to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the median as the media pass through the deposition region. In some inkjet printing systems, the media transport device utilizes vacuum suction to assist in holding the print median against a movable support surface (e.g., conveyor belt, rotating drum, etc.) of the transport device. Vacuum suction to hold the print median against the support surface can be achieved using a vacuum source (e.g., fans) and a vacuum plenum fluidically coupling the vacuum source to a side of the moving surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport device utilizing vacuum suction is unintended blurring of images resulting from air currents induced by the vacuum suction. In some systems, such blurring may occur in portions of the printed image that are near the edges of the print media, particularly those portions that are near the inboard or outboard edges of the print media. Generally, the holes for vacuum suction are arranged to extend across more-or-less the full width of the deposition region in the cross-process direction so that the holes are able to hold down any size of print media that the system is designed to use, from the smallest to the largest sizes. However, if the print medium currently being printed is smaller than the largest size, it may not extend far enough in the cross-process direction to cover all the holes. Thus, holes adjacent to one side of the print medium will be uncovered.

Because these holes are uncovered, the vacuum of the vacuum plenum induces air to flow through those uncovered holes. This airflow may deflect ink droplets as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly comprising one or more printheads arranged to eject a print fluid to a deposition region of the ink deposition assembly; a media transport device comprising a movable support surface, the media transport device configured to hold a print medium against the movable support surface by vacuum suction through holes in the media transport device and transport the print media along a process direction though the deposition region; an airflow control system and a controller. The airflow control system comprises a damper that is moveable in the cross-process direction, the damper arranged to block airflow through a subset of the holes, the subset varying based on a position of the damper; and an actuator operably coupled to the damper and configured to move the damper. The controller is configured to cause the actuator to selectively move the damper to change the subset of the holes blocked by the damper based on a size of the print medium.

In accordance with at least one embodiment of the present disclosure, a method, comprises transporting a print medium through a deposition region of a printhead of the printing system, wherein the print medium is held during the transporting against a moving support surface of a media transport device via vacuum suction through holes in the media transport device; ejecting print fluid from the printhead to deposit the print fluid to the print medium in the deposition region; and controlling an airflow control system to selectively block a subset of the holes by moving a damper along the cross-process direction, the subset of the holes varying based on a position of the damper. Selectively blocking the subset of the holes comprises selectively moving the damper to change the subset of the holes blocked by the damper based on the size of the print medium.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1A:
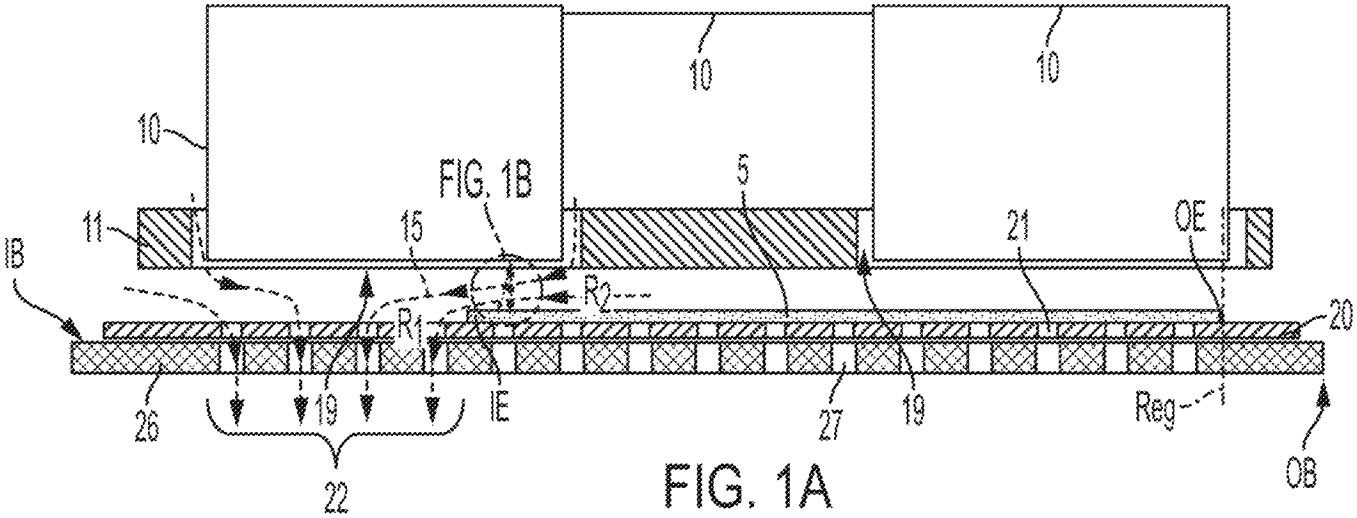
FIG. 1A RELATED ART
FIGS. 1A-1F schematically illustrate air flow patterns relative to a printhead assembly, transport device, and print media during differing stages of print media transport through an ink deposition region of a conventional inkjet printing system, and resulting blur effects in the printed media product.
Figure 1C:
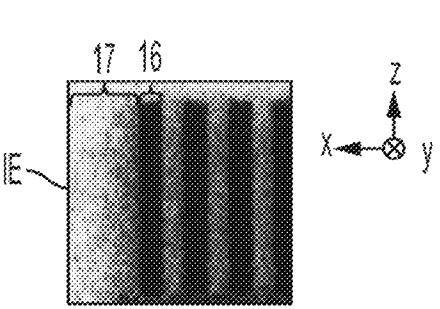
Figure 1B:
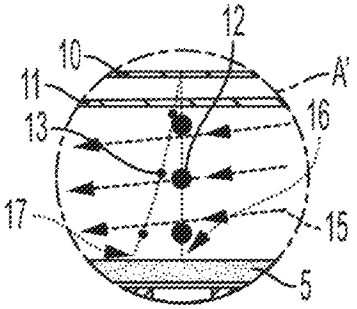
Figure 1D:
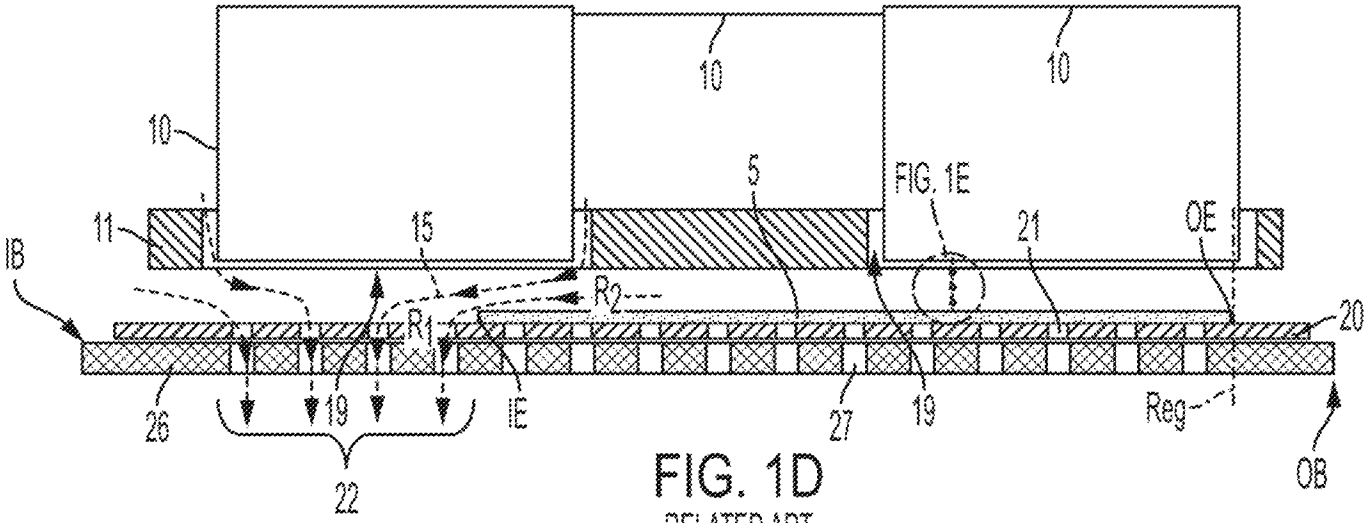
FIG. 1D RELATED ART
Figure 1F:
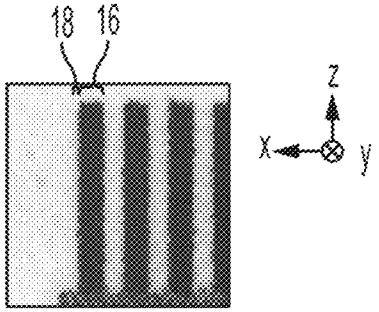
Figure 1E:
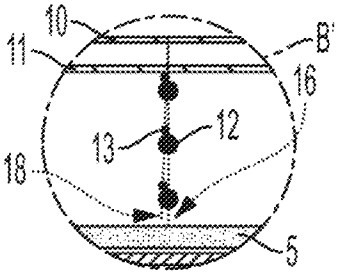

As described above, when an uncovered region is near or under a printhead, the uncovered holes in the uncovered region can create crossflows that can blow satellite droplets off course and cause image blur. To better illustrate some of the phenomenon occurring giving rise to the blurring issues, reference is made to FIGS. 1A-1F. FIGS. 1A and 1D illustrate schematically printheads 10 printing on a print medium 5 near an inboard edge IB and a middle, respectively, of the print medium 5. FIGS. 1B and 1E illustrate enlarged views of the regions A and B, respectively, from FIGS. 1A and 1D. FIGS. 1C and 1F illustrate enlarged pictures of printed images, the printed images comprising lines printed near the inboard edge IB and middle, respectively, of a sheet of paper.

As shown in FIGS. 1A, 1D, and 1G, an inkjet printing system comprises printheads 10 to eject ink through openings 19 of a carrier plate 11 onto a print medium 5. A movable support surface 20 transports the print media 5 in a process direction P, which corresponds to a positive y-axis direction in the Figures. The moving support surface 20 slides over a vacuum platen 26, and a vacuum environment is provided on a bottom side of the platen 26. The moving support surface 20 has holes 21 and the vacuum platen 26 has holes 27, and the holes 21 and 27 periodically align so as to expose the region above the moving support surface 20 to the vacuum below the platen 26. In regions where the print medium 5 covers the holes 21, the vacuum suction through the holes 21 and 27 generates a suction force that holds the print medium 5 against the moving support surface 20. However, little or no air flows through these covered holes 21 and 27 since they are blocked by the print medium 5. On the other hand, as shown in FIG. 1A, in the uncovered region 22 alongside the print medium 5, the holes 21 and 27 are not covered by the print medium 5, and therefore the vacuum suction pulls air to flow down through the holes 21 and 27 in the uncovered region 22. This creates airflows, indicated by the dashed arrows in FIGS. 1A and 1D, which flow from regions around the printhead 10 towards the uncovered holes 21 and 27 in the uncovered region 22.

Some of the air flowing toward the uncovered region 22 will be pulled from an outboard side of the printhead 10, for example from the region $R_2$, and this air will flow under the printhead 10 in an inboard direction, which in FIG. 1A corresponds to a positive x-axis direction. More specifically, the vacuum suction from the uncovered region 22 lowers the pressure in the region $R_1$ above the uncovered region 22, thus creating a pressure gradient between the region $R_1$ and the region $R_2$ on an outboard side of the printhead 10, which is at a relatively higher pressure. This pressure gradient causes air to flow in an inboard direction from the region $R_2$ towards the region $R_1$, and then ultimately down through the holes 21 and 27. This air flowing from the outboard side of the printhead 10 (region $R_2$) towards the uncovered region 22 (region $R_1$) crosses under the printhead 10 and passes through a region where ink is being ejected, e.g., the circled region in FIG. 1A. Such air flows crossing through the region where ink is being ejected are referred to herein as crossflows 15.

As shown in the enlarged view A' in FIG. 1B, which comprises an enlarged view of the circled region in FIG. 1A, as ink is ejected from the printhead 10 towards the medium 5, main droplets 12 and satellite droplets 13 are formed. The satellite droplets 13 are much smaller than the main droplets 12 and have less mass and momentum, and thus the upstream crossflows 15*a* tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in the actual printed image in FIG. 1C, in which the denser/darker line-shaped portion is formed by the main droplets 12 which were deposited predominantly at their intended locations 16, whereas the smaller dots dispersed away from the line are formed by satellite droplets 13 which were blown away from the intended locations 16 to land in unintended locations 17, resulting in a blurred or smudged appearance for the printed line. Notably, the blurring in FIG. 1C is asymmetrically biased towards the inboard edge IE, due to the crossflows 15 near the inboard edge IE blowing primarily in an inboard direction. The uncovered region 22 may also induce other airflows flowing in other directions, such as airflows in an outboard direction from an inboard side of the carrier plate 11, but these other airflows do not pass through the region where ink is currently being ejected in the illustrated scenario and thus do not contribute to image blur. Only those airflows that cross through the ink ejection region are referred to herein as crossflows.

In contrast, as shown the enlarged view B' in FIG. 1E, which corresponds to an enlarged view of the circled region in FIG. 1D, farther from the edges of the print media 5 there may be little or no crossflows 15 because the inter-media zone 22 is too distant to induce much airflow. Because the crossflows 15 are absent or weak farther away from the edges of the print medium 5, the satellite droplets 13 in this region are not as likely to be blown off course. Thus, as shown in FIGS. 1E and 1F, when printing farther from the edges of the print medium 5, the satellite droplets land at locations 18 that are much closer to the intended locations 16 resulting in much less image blurring. The deposition locations 18 of the satellite droplets may still vary somewhat from the intended locations 16, due to other factors affecting the satellite droplets 13, but the deviation is smaller than it would be near the inboard edge IE.

In FIGS. 1A-1C, the print medium 5 is registered to an outboard side of the moving support surface—i.e., the outboard edge OE of the print medium 5 is aligned with a registration location Reg that is near the outboard side OB of the media transport device. Thus, in this situation the uncovered region 22 is located along the inboard edge IE of the print media 5, and therefore the blurring occurs primarily in portions of the image that are near the inboard edge IE of the print media 5. If, on the other hand, the print media 5 were registered to the inboard side IB of the media transport device, the same phenomenon would occur except that the uncovered region would be located along the outboard side OB and the blurring would occur primarily near the outboard edge OE of the print media 5. Furthermore, it is possible for uncovered regions to appear on both outboard and inboard sides of the print media, for example if the print medium is centered on the moving support surface rather than being registered to one side. To simplify the discussion, the description below will describe situations in which the print media are registered to an outboard side of the media transport device and the uncovered holes occur on the inboard side of the print media. But the devices and techniques disclosed herein are equally applicable to embodiments in which the print media are registered differently and the devices, and techniques disclosed herein can be used to mitigate edge blur on the inboard edge, outboard edge, or both edges.

Embodiments disclosed herein may, among other things, reduce or eliminate such image blur by utilizing an airflow control system that reduces or eliminates the crossflows. Airflow control systems in accordance with various embodiments reduce or eliminate the crossflows by selectively blocking holes of the media transport device under the uncovered region. For example, a damper is positioned on a bottom side of the transport device and is moved so that it is positioned under the uncovered holes. The damper blocks airflow through the uncovered holes, thereby preventing the formation of the crossflows. The positioning of the damper may be determined based on the size of the print media being printed. For example, the damper may be positioned such that all of the uncovered holes inboard of the printheads are blocked, so as to prevent crossflows, but none of the holes covered by the print media are blocked, so as not to interfere with the holding down of the print media. With the crossflows reduced or eliminated, the satellite droplets are more likely to land nearer their intended deposition locations, and therefore the amount of blur is reduced.

Figure 2:
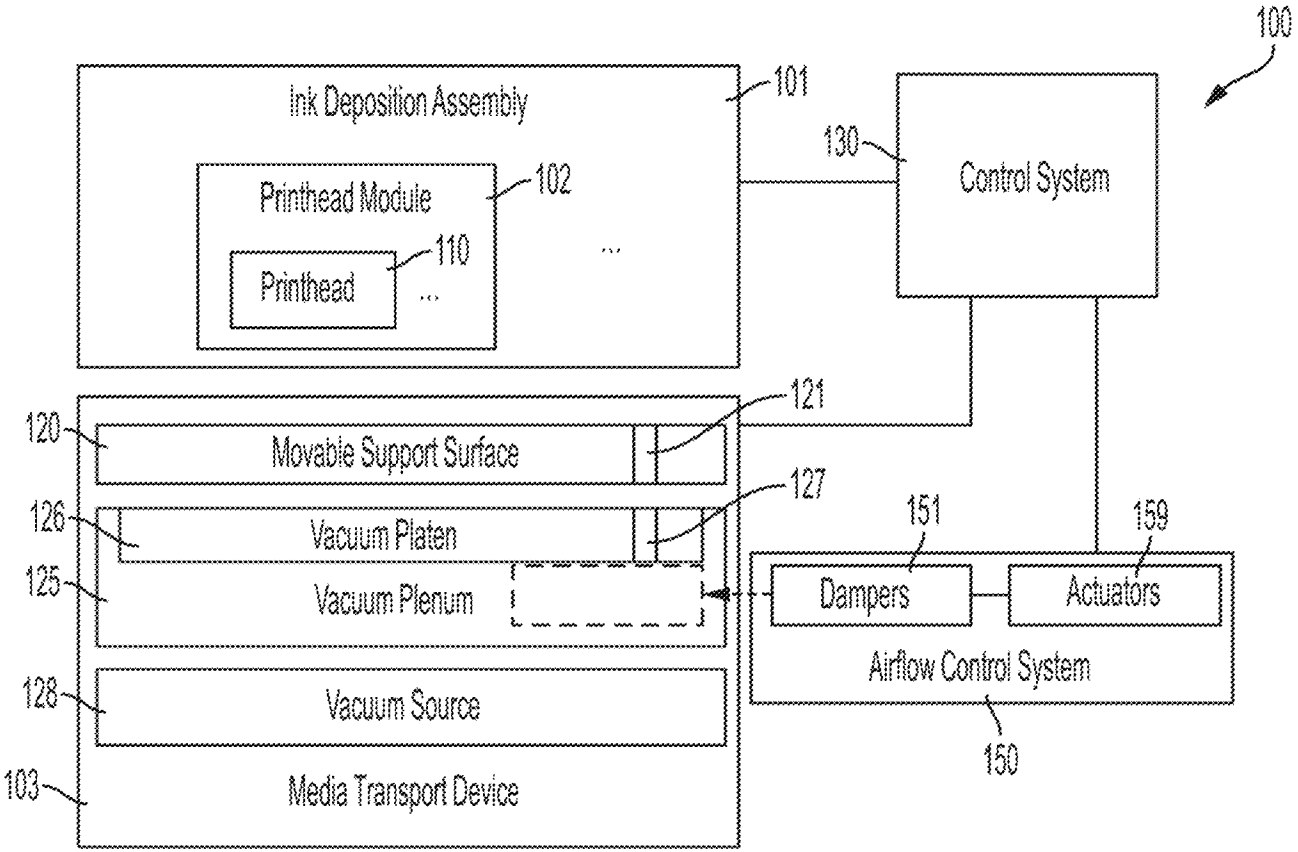
FIG. 2 comprises is a block diagram illustrating components of an embodiment of an inkjet printing system including an air flow control system.

FIG. 2 schematically illustrates a printer 100 utilizing the above-described blur reduction system. The printer 100 comprises a printing assembly 101, a media transport device 103, a blur reduction system 150, and a control system 130. These components of the printer 100 are described in greater detail in turn below.

The printing assembly 101 comprises one or more printhead modules 102. One printhead module 102 is illustrated in FIG. 2 for simplicity, but any number of printhead modules 102 may be included in the printing assembly 101. In some embodiments, each printhead module 102 may correspond to a specific ink color, such as cyan, magenta, yellow, black, white, clear, or any custom color. Each printhead module 102 comprises one or more printheads 110 configured to eject ink onto the print media to form an image. In FIG. 2, one printhead 110 is illustrated in the printhead module 102 for simplicity, but any number of printheads 110 may be included per printhead module 102. The printhead modules 102 may also include additional structures and devices to support and facilitate operation of the printheads 110, such as carrier plates 111, ink supply lines, ink reservoirs, electrical connections, and so on, as known in the art.

As shown in FIG. 2, the media transport device 103 comprises a moving support surface 120, a vacuum plenum 125, and a vacuum source 128. The moving support surface 120 transports the print media through a deposition region of the printing assembly 101. The vacuum plenum 125 supplies vacuum suction to one side of the moving support surface 120 (e.g., a bottom side), and print media is supported on an opposite side of the moving support surface 120 (e.g., a top side). Air holes 121 through the moving support surface 120 communicate the vacuum suction through the surface 120, such that the vacuum suction holds down the print media against the surface 120. The moving support surface 120 is movable relative to the printing assembly 101, and thus the print media held against the moving support surface 120 is transported relative to the printing assembly 101 as the moving support surface 120 moves. Specifically, the moving support surface 120 transports the print media through a deposition region of the printing assembly 101, the deposition region being a region in which print fluid (e.g., ink) is ejected onto the print media, such as a region under the printhead(s) 110. The moving support surface 120 can comprise any structure capable of being driven to move relative to the printing assembly 101 and which has air holes 121 to allow the vacuum suction to hold down the print media, such as a belt, a drum, etc. The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the moving support surface 120 such that the moving support surface 120 is exposed to the vacuum state within the vacuum plenum 125. In some embodiments, the moving support surface 120 is supported by a vacuum platen 126, which may be a top wall of the vacuum plenum 125. In such an embodiment, the moving support surface 120 is fluidically coupled to the vacuum in the plenum 125 via air holes 127 through the vacuum platen 126. In some embodiments, the moving support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

The control system 130 comprises processing circuitry to control operations of the printer 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

The airflow control system 150 comprises a damper 151 and an actuator 159. The damper 151 is arranged inside the vacuum plenum 125 and is configured to be movable in a cross-process direction between a fully deployed configuration and an undeployed configuration. In the fully deployed configuration, the damper 151 extends along the cross-process direction and is positioned under the vacuum platen 126 to selectively block airflow through a group of holes 127 on an inboard side of the print media 5. In the undeployed configuration, the damper 151 does not block any of the holes 127. The damper 151 may also be moved to positions between the fully deployed and undeployed configurations, and in such intermediate positions the damper 151 blocks different groups of holes 127 depending on how far the damper 151 is deployed. The actuator 159 is a device configured to drive movement of the damper, such as a linear actuator 152 (see FIGS. 5-6C), a rotary actuator (see FIGS. 7A-B), or any other actuator. The actuator 159 may utilize electrical motive power, hydraulic motive power, pneumatic motive power, or any other desired motive power.

The airflow control system 150 is configured to selectively block a variable subset of the holes 127 based on the size of the print media 105. This means that the airflow control system 150 is configured to change which (if any) of the holes 127 are blocked by the damper 151, and to select which subset of holes 127 to block based on the size of the print media 105. The airflow control system 150 changes which holes 127 are blocked by moving the damper 151 in a cross-process direction (e.g., positive or negative x-axis direction in FIGS. 3-9B). In an embodiment, the damper 151 is positioned to block each uncovered hole 127 that is in the uncovered region 122 (at least in vicinity of the deposition region) while not blocking any holes 126 that are covered by the print media 105.

A controller, which may be part of the control system 130, is configured to determine where to move the damper 151 (e.g., which holes 127 to block). The controller also generates signals to control the actuators 159 to cause the actuators 159 to move the damper 151 at the determined timings. The controller comprises one or more electronic circuits configured with logic to perform the options described herein. In some embodiments, the electronic circuits of the controller are part of the processing circuitry of the control system 130 described above, and therefore the controller is not separately illustrated in FIG. 2.

In some embodiments, positions for the damper 151 are pre-determined (i.e., determined outside of operation) for various sizes of print media 105, and this information is stored in a look-up table or other data structure. Thus, during operation the controller may determine the position for the damper 151 by searching the look-up table or other data structure based on the size of the print media 105 currently being printed or currently selected for printing. In some embodiments, positions for the damper 151 are determined dynamically during operation. To determine the position of the damper 151 for a given size of print media 105, a location on the platen 126 corresponding to the inboard edge IE of the print media is determined. In embodiments in which the controller determines the location of the inboard edge IE, the controller may either obtain direct knowledge of the location of the inboard edge IE, for example via a sensor, or may infer the location of the inboard edge IE based on other known parameters. For example, the controller may know the dimensions of the print medium 105 that is currently selected for a print job, as well as the location of a registration datum Reg to which the outboard edge OE of the print medium 105 is registered, and this information may be used to calculate the location of the inboard edge IE. Based on the location of the inboard edge IE, the controller can position the damper 151 to block the desired holes 127, such as the holes 127 on an inboard side of the inboard edge IE, while not blocking other holes 127, such as the holes 127 on an outboard side of the inboard edge IE. In some embodiments, the controller positions the damper 151 such that an outboard edge of the damper 151 is at the same location as the inboard edge IE. In such embodiments the controller does not need to explicitly identify which holes 127 are on the inboard side of the inboard edge IE, as aligning the damper 151 to the location of the inboard edge IE automatically ensures that the correct holes 127 are blocked. In other embodiments, the controller may use the location of the inboard edge IE together with knowledge of the locations of the holes 127 to explicitly determine which holes 127 are on the inboard side of the inboard edge IE, and may position the damper 151 accordingly.

Figure 3:
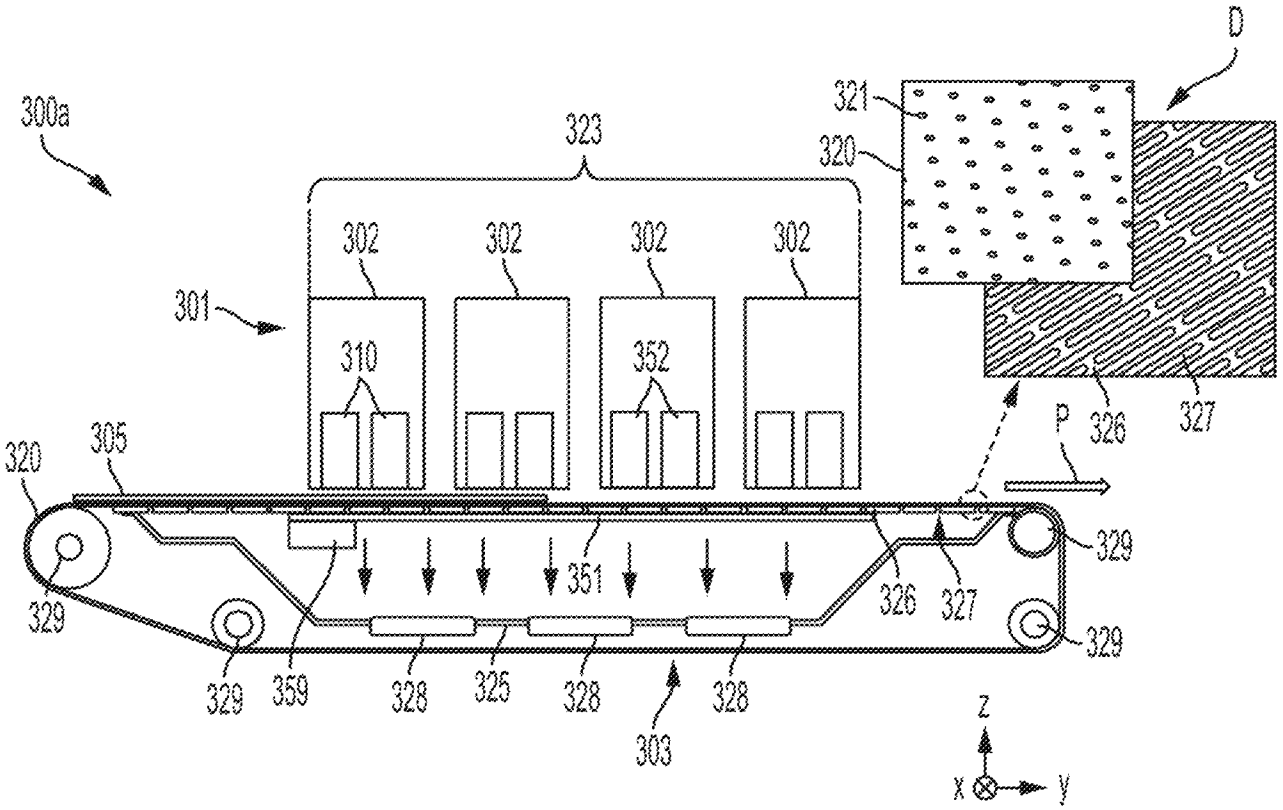
FIG. 3 is a schematic illustration of components of an embodiment of an inkjet printing system including an air flow control system.
Figure 4:
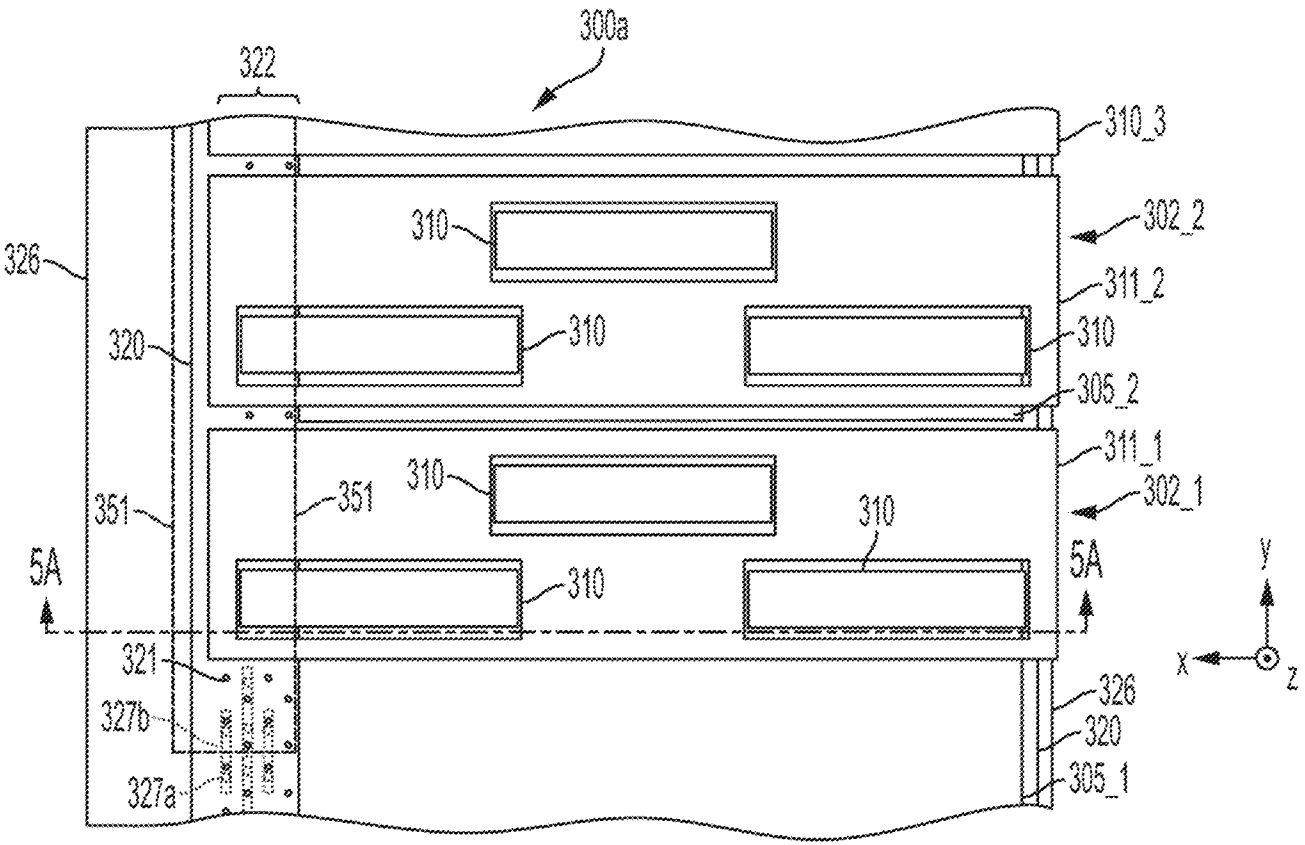
FIG. 4 is a plan view from above the printhead assembly the inkjet printing system of FIG. 3.

FIGS. 3-5B illustrate a printing system 300, which may be used as the printing system 100 described above with reference to FIG. 2. FIG. 3 comprises a schematic illustrating a portion of the printing system 300 from a side view. FIG. 4 comprises a plan view from above a portion of the printing system 300. In FIG. 4, some components that would not otherwise be visible in the view because they are positioned below other components are illustrated with dashed or dotted lines. 5A-5B comprise cross-sections with the section taken along line C-C in FIG. 4.

As illustrated in FIG. 3, the printing system 300 compromises an ink deposition assembly 301, a media transport device 303, and an airflow control system 350, which can be used as the ink deposition assembly 101, media transport device 103, and airflow control system 150, respectively. The printing system 300 may also comprise additional components not illustrated in FIGS. 3-6B, such as a control system (e.g., the control system 130).

In the printing system 300, the ink deposition assembly 301 comprises four printhead modules 302 as shown in FIG. 3, with each module 302 having three printheads 310 as shown in FIG. 4. As shown in FIGS. 3 and 4, the printhead models 302 are arranged in series along a process direction P above the media transport device 303, such that the print media 305 is transported sequentially beneath each of the printhead modules 302. The printheads 310 are arranged to eject print fluid (e.g., ink) through respectively corresponding openings 319 in a corresponding carrier plate 311, with a bottom end of the printhead 310 extending down partway into the opening 319. In this embodiment, the printheads 310 are arranged in an offset pattern with one of the printheads 310 being further upstream or downstream than the other two printheads 310 of the same printhead module 302. In other embodiments, different numbers and/or arrangements of printheads 310 and/or printhead modules 302 are used.

In the printing system 300, media transport device 303 comprises a flexible belt providing the movable support surface 320. As shown in FIG. 4, the moving support surface 320 is driven by rollers 329 to move along a looped path, with a portion of the path passing through the ink deposition region of the ink deposition assembly 301. In this embodiment, the vacuum plenum 325 comprises a vacuum platen 326, which forms a top wall of the plenum 325 and supports the moving support surface 320. The platen 326 comprises platen holes 327, which allow fluidic communication between the interior of the plenum 325 and the underside of the moving support surface 320.

In some embodiments, a platen hole 327 includes a bottom portion 327*a* which opens to a bottom side of the platen 326 and a top portion 327*b* which opens to a top side of the platen 326, with the top portion 327*b* being differently sized and/or shaped than the bottom portion 327*a*. An embodiment of the platen holes 327 is shown in the expanded cutaway D in FIG. 3 and in a portion of FIG. 4. In this embodiment, the bottom portion 327*a* comprises a through-hole and the top portion 327*b* comprises a channel coupled to the through-hole, with the channel being elongated in the process direction. In some embodiments, multiple holes 327 may share the same top portion 327*b*. The holes 327 are arranged in columns extending in the process direction, with each column comprising a group of holes 327 that are aligned with one another in the process direction. In some embodiments, the platen holes 327 are offset or staggered in the process direction from one column to the next. In some embodiments, the platen holes 327 are arranged in a uniform pattern, but in other embodiments the platen holes 327 are not arranged in a uniform pattern. The holes 321 of the moving support surface 320 are disposed such that each hole 321 is aligned in the cross-process direction (x-axis) with a collection of corresponding platen holes 327. In particular, in the printing system 300, each hole 321 is aligned with one of the columns of platen holes 327. Thus, as the moving support surface 320 slides across the platen 326, each hole 321 will periodically move over a corresponding platen hole 327, resulting in the hole 321 and the platen hole 327 being temporarily aligned in a z-axis direction. When an hole 321 moves over a corresponding platen hole 327, the holes 321 and 327 define an opening that fluidically couples the environment above the moving support surface 320 to the low-pressure state in the vacuum plenum 325, thus generating vacuum suction through the holes 321 and 327. This suction generates a vacuum hold down force on a print medium 305 if the print medium 305 is disposed above the hole 321.

In another embodiment (not illustrated), the moving support surface 320 comprises a rigid cylindrical drum that is driven to rotate around an axis, with the print media being supported on an outer circumferential surface of the drum and with the vacuum environment being located inside the drum. In some embodiments in which a drum is used as the moving support surface 320, the walls of the drum are sufficiently rigid to support themselves, and thus no separate vacuum platen 326 is provided to support them. Thus, in such embodiments, the walls of the drum defines the vacuum plenum 325 and the circumferential walls of the drum serve as both the moving support surface 320 and as the vacuum platen 326.

The airflow control system 350 comprises a damper 351, as described above in relation to FIG. 2. The damper 351 may be used as the damper 151 and actuators 359 described above in relation to FIG. 2. As shown in FIGS. 3-5B, in the printing system 300, the damper 351 is disposed under the vacuum platen 326 against a bottom surface thereof and near the inboard side IB of the platen 326. The damper 351 is positioned in a cross-process direction so as to be under the holes 327 that are in the uncovered region 322. Because the damper 351 blocks airflow through the uncovered holes 327, the formation of the crossflows through those holes 327 is prevented. More specifically, with reference to FIG. 5A, the damper 351 prevents the region $R_1$ above the uncovered region 322 from being exposed to the vacuum state below the platen 326, and therefore the region $R_1$ and the region $R_2$ stay at approximately the same pressure. Because the regions $R_1$ and $R_2$ are at approximately the same pressure, there is little to no airflow induced between the regions $R_2$ and $R_1$, and hence little or no crossflows 35. In addition to reducing image blur, blocking the uncovered holes can also reduce the overall vacuum needs of the system, reduce drag on the movable support surface 320, and reduce the drying of print heads 310 in the areas that are not being printing.

As shown in FIGS. 3 and 4, the damper 351 of the airflow control system 350 has a longitudinal dimension extending along the process direction P (y-axis direction). In the printing system 300, the damper 351 is sized to extend in the process direction at least along the entire length of the deposition region 323, which is the region covered by the print modules 302. In some embodiments, the damper 351 extends across the full length of the platen 326. This may be beneficial in that it allows more uncovered holes to be blocked, which has various beneficial effects as noted above. In other embodiments the damper 351 extends less than the full length of the platen 326. In the printing system 300, a single damper 351 is provided to block the holes 327 along the entire inboard side of the deposition region 323. In other embodiments, multiple dampers 351 are arranged in series along the process direction to block some or all of the holes 327 along an inboard side of the deposition region—for example, one damper 351 may be disposed per printhead module 302 to block holes near the corresponding printhead module 302. As noted above, various embodiments may have different numbers and/or configurations of printhead modules 302, as well as different numbers and/or configurations of printheads 310 within each module 302, but the configuration of the airflow control system 350 in such embodiments may be similar to that described herein except that the length and/or the number of damper(s) 351 may vary.

Figure 5A:
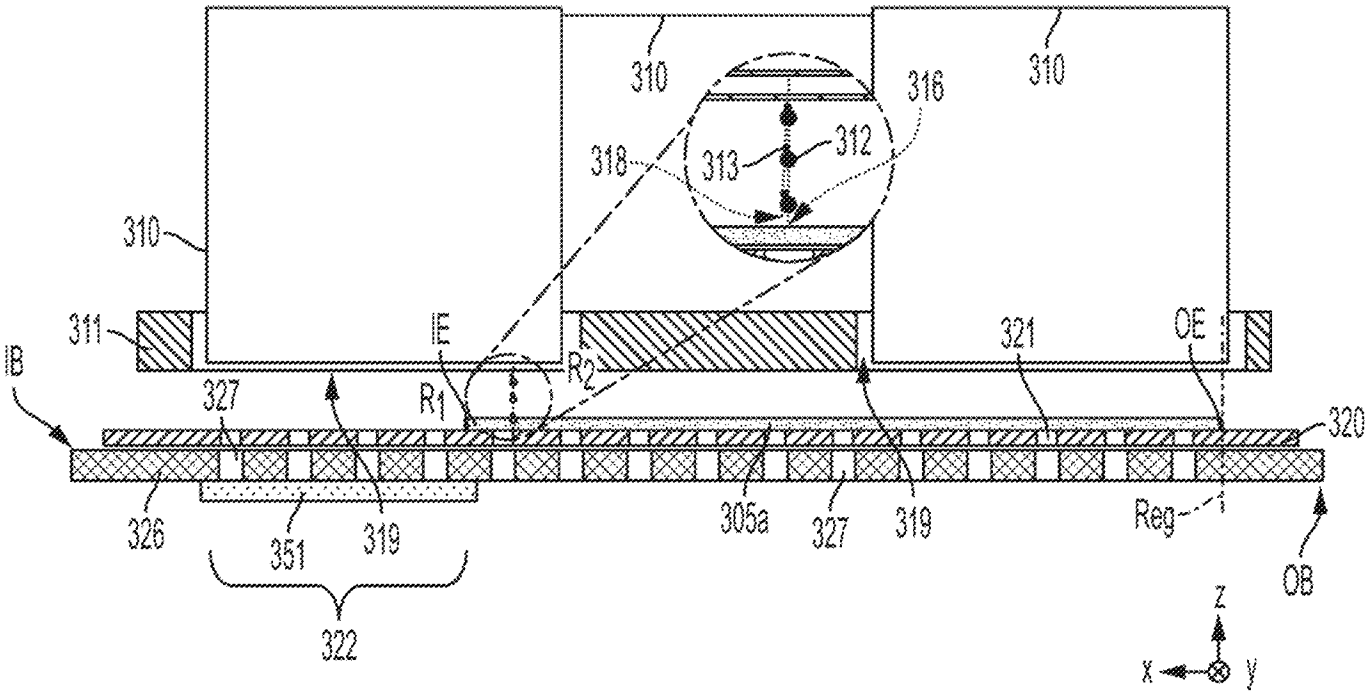
FIGS. 5A-5B are cross-sectional views of the inkjet printing system of FIG. 4, with the cross-section taken along a cross-process direction the line C-C in FIG. 4.
Figure 5B:
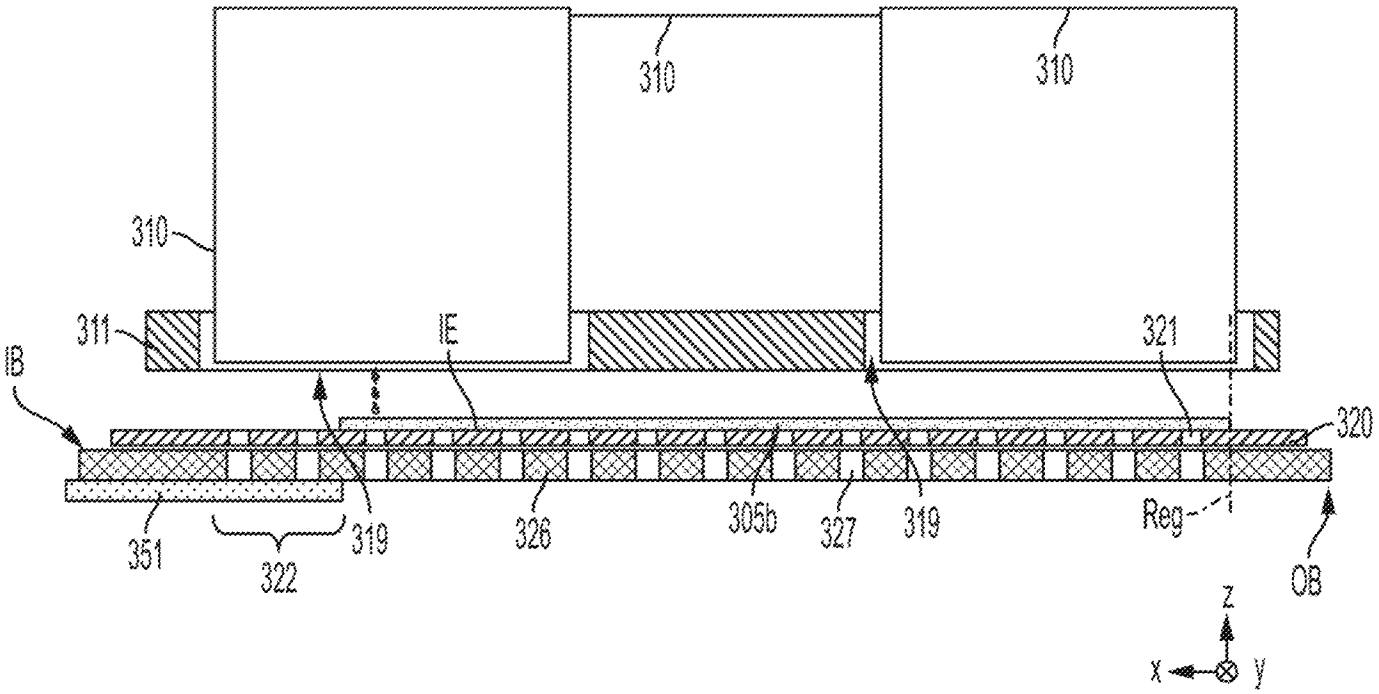

As noted above, the airflow control system 350 is configured to selectively block a subset of the holes 327 based on the size of the print media 305. In the printing system 300, the airflow control system 350 is configured to position the damper 351 such that it blocks each column of holes 327 that is inboard of the inboard edge IE of the print media 305 while not blocking columns of holes 327 that outboard of the inboard edge IE. Thus, the subset of holes 327 that are blocked may comprise each hole 327 that is both inboard of the inboard edge IE and also in the deposition region 323, and excludes holes 327 that are covered by the print media 305. To illustrate this selective blocking of holes 327 based on the size of the print media 305, reference is made to FIGS. 5A-5B, which show the damper 351 in two positions associated with two different sizes of print media 305. In FIG. 5A a first print medium 305*a* is used, and therefore the damper 351 is positioned in a first position associated with the size of the first print medium 305*a* so as to block a first subset of holes 327. Specifically, in the state illustrated in FIG. 5A, the first print medium 305*a* covers all but the four most inboard columns of holes 327—in other words, the uncovered region 122 comprises the first four columns of holes 327 on the inboard side IB. Accordingly, the damper 351 is positioned such that the first subset of holes 327 blocked by the damper 351 comprises the holes 327 in the four most inboard columns, while excluding the other columns of holes 327 which remain unblocked. In FIG. 5B a second print medium 305*b* is used that is larger than the print medium 305*a*, and accordingly the damper 351 is repositioned to a second position associated with the size of the second print medium 305*b* so as to block a second subset of holes 327. Specifically, in FIG. 5B, the print medium 305*b* covers all but the two most inboard columns of holes 327, and thus the uncovered region 122 comprises the first two columns of holes 327 from the inboard side IB. Therefore the damper 351 is positioned such that such that the second subset of holes 327 blocked by the damper 351 comprises the holes 327 in the two most inboard columns, while excluding the other columns of holes 327 which remain unblocked. Thus, crossflows can be reduced or eliminated, while not impairing the vacuum hold down on the print media 305.

Turning now to FIGS. 6A-10, embodiments of airflow control systems will be described, namely airflow control systems 650, 850, and 1050. The airflow control systems 650, 850, and 1050 can be used as the airflow control systems 150 or 350 described above. To aid understanding, the airflow control systems 650, 850, and 1050 in FIGS. 6A-10 are illustrated and described in the context of ink deposition assemblies similar to the ink deposition assembly 301 and media transport devices similar to the media transport device 303, but it should be understood that the airflow control systems 650, 850, and 1050 could be used in other printing system having differently configured printing assemblies and the media transport devices.

Figure 6A:
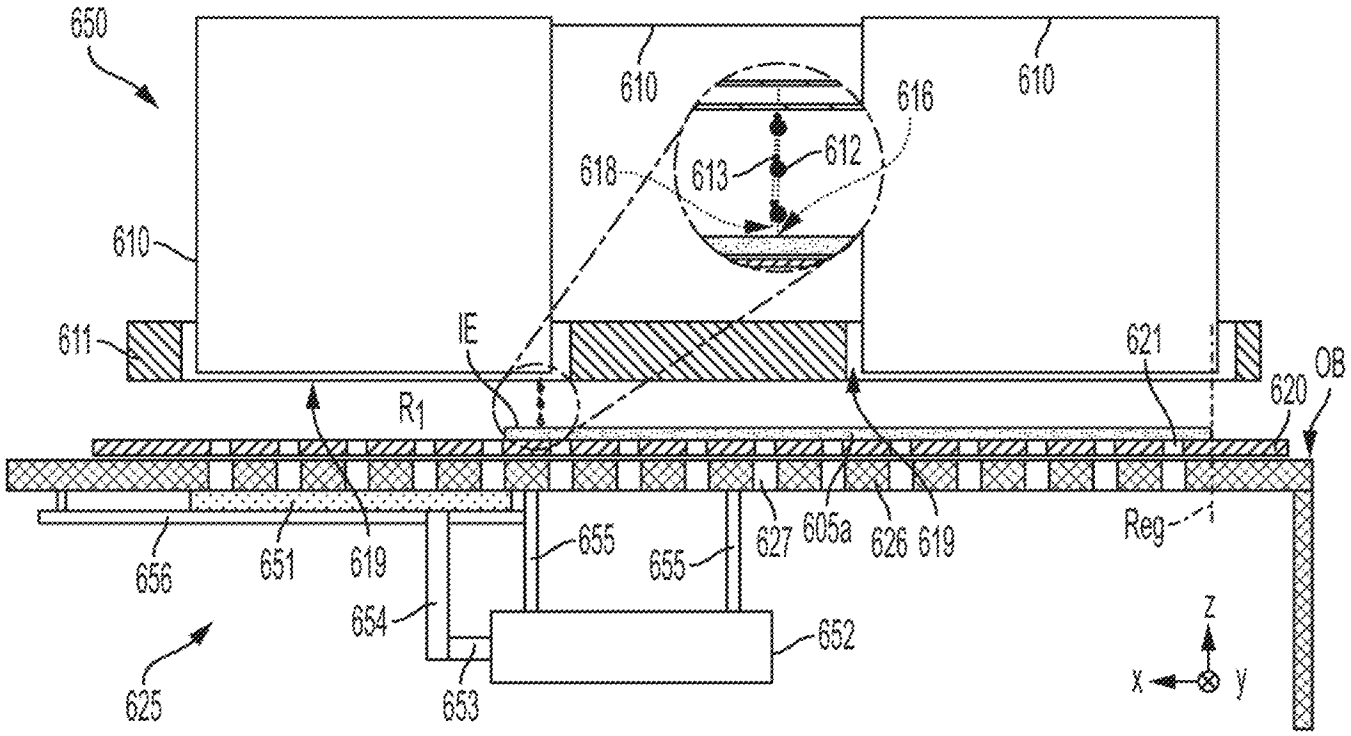
FIGS. 6A-6C are cross-sectional views of an embodiment of an inkjet printing system, with the cross-section taken along the line C-C in FIG. 4.
Figure 6B:
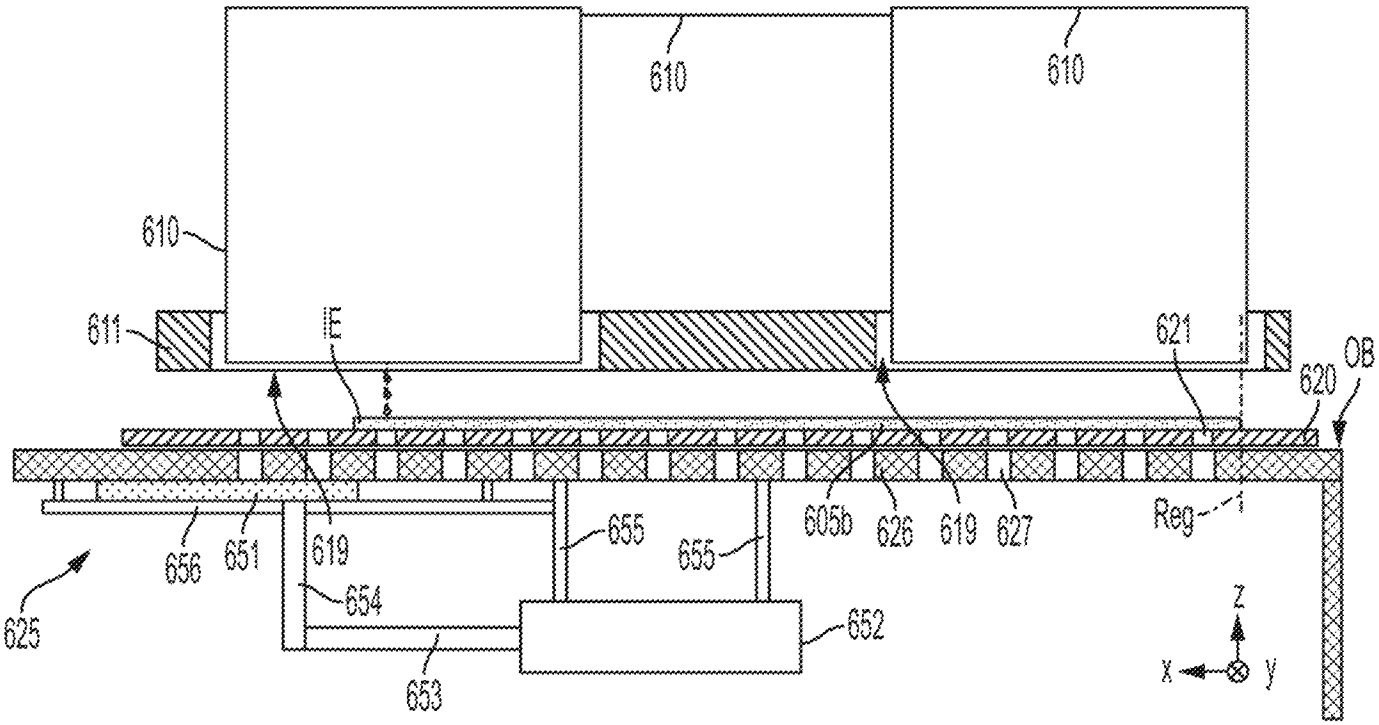
Figure 6C:
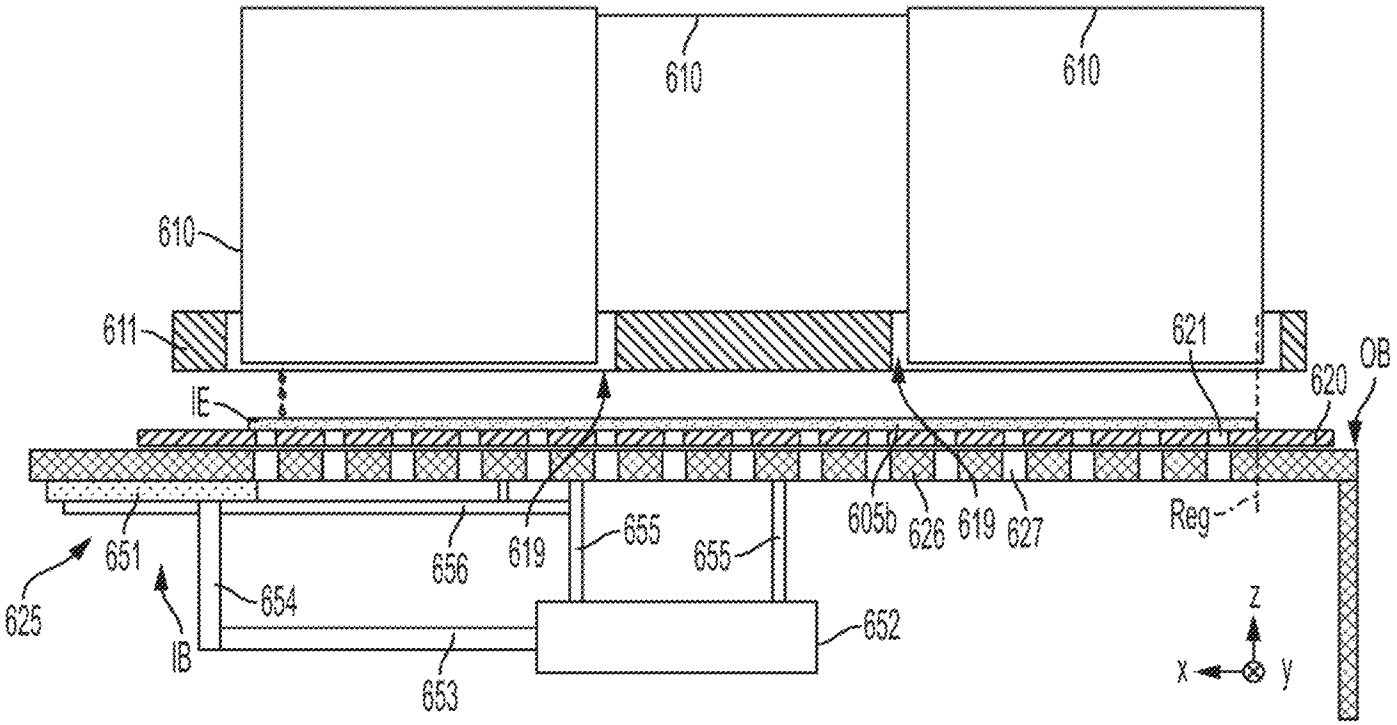
Figure 7A:
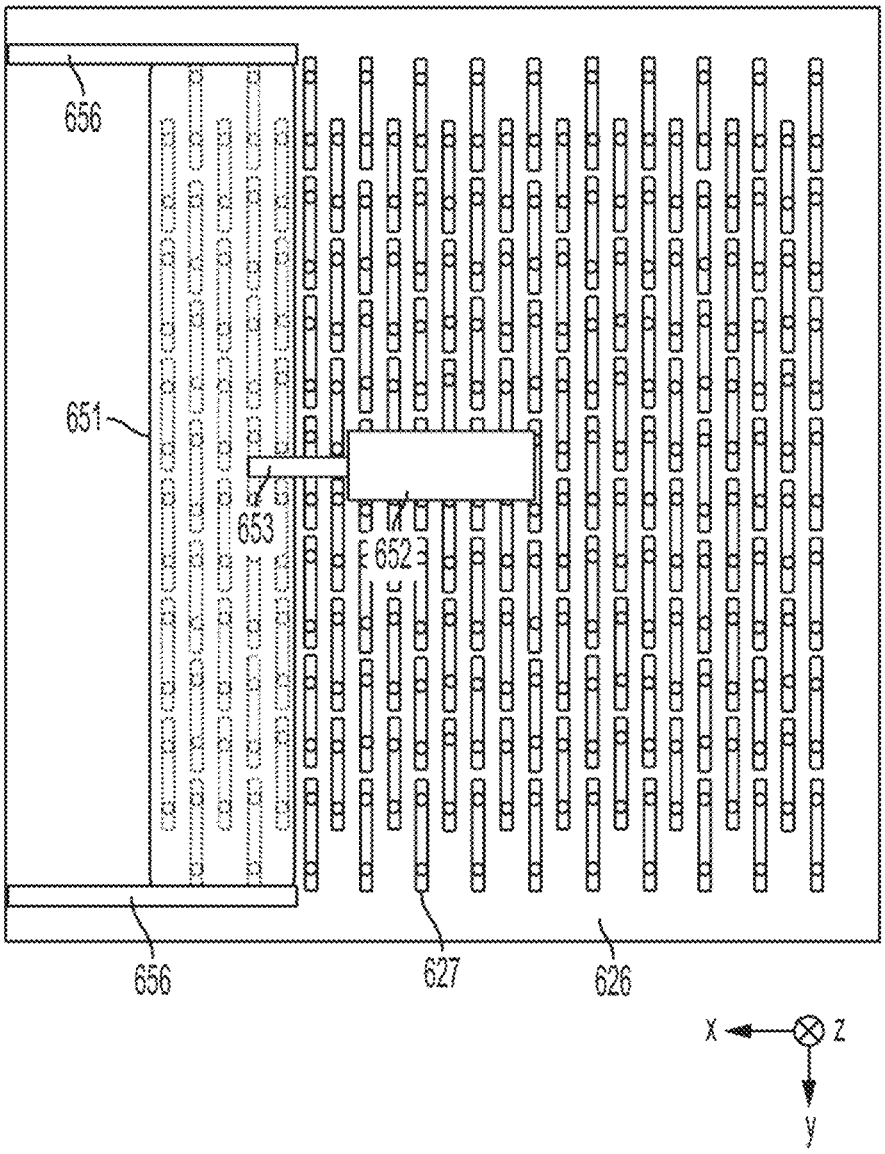
FIGS. 7A-7B are plan views of the printing system of FIGS. 6A-6C from below a vacuum platen.
Figure 7B:
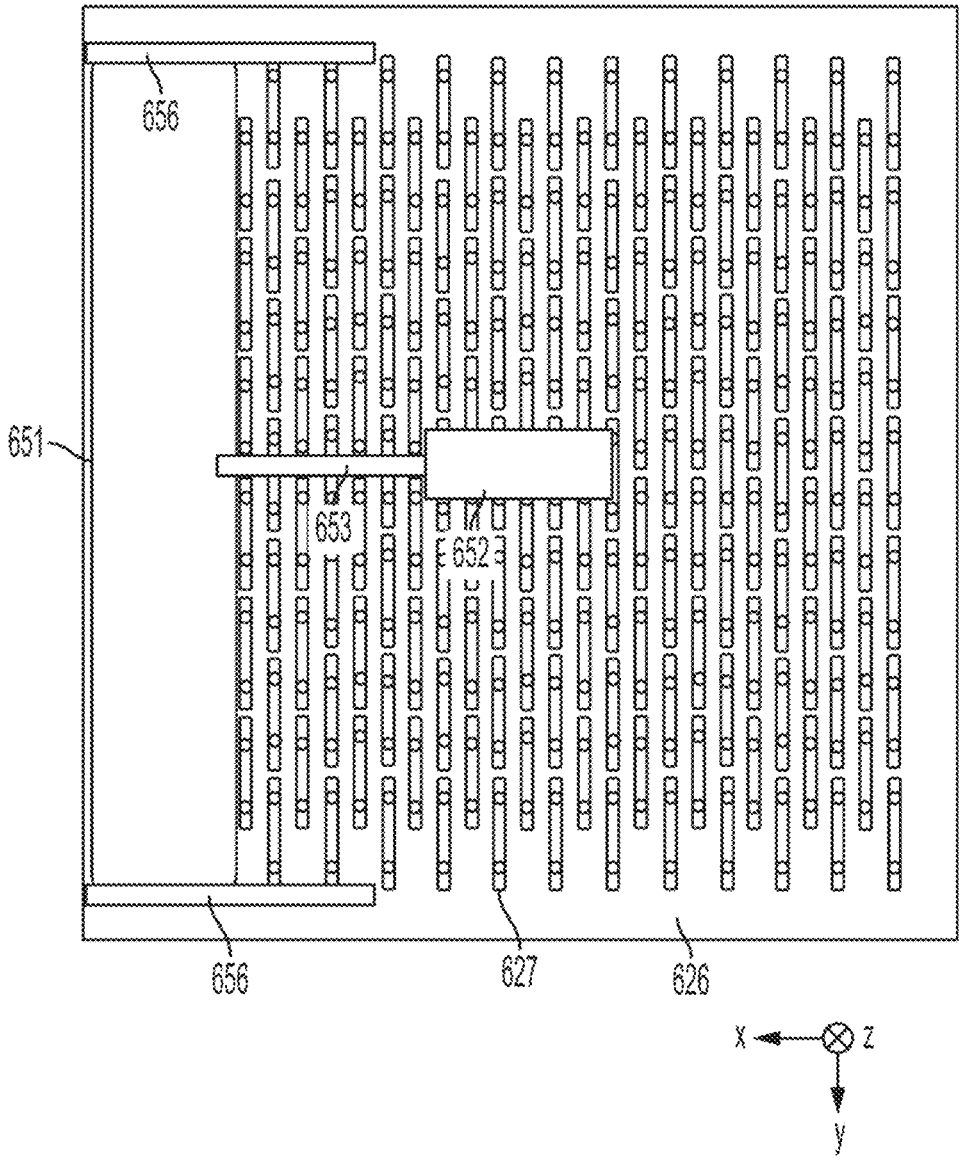

FIG. 6A-7B illustrate the airflow control system 650, which can be used as the airflow control systems 150 or 350 described above. FIG. 6A-6C comprise cross-sections taken along the line C in FIG. 4, with FIGS. 6A-6C showing states in which the damper 651 is in different positions to accommodate different sizes of print media 605. FIGS. 7A-7B comprise plan views from below the vacuum platen 626, with FIGS. 7A and 7B showing the same states as are illustrated in FIGS. 6A and 6C, respectively. In FIGS. 6A-7B, some items that would not normally visible in the illustrated view, for example because they are under or behind another object, may be shown using dashed or dotted lines.

As shown in FIGS. 6A-7B, the damper 651 is positioned under the vacuum platen 626 towards an inboard side IB of the platen 626. In this embodiment, the damper 651 comprises a rigid plate, such as a plastic or metal plate, which is moved in a cross-process direction (x-axis direction in the figures) by a linear actuator 652. As shown in FIGS. 6A-7B, the damper 651 may be supported and guided in its motion by rails 656, which may slidably engage the ends of the damper 651. The rails 655 may be stationary relative to the vacuum platen 626. For example, the rails 655 may be secured to the vacuum platen 626 (e.g., via screws, bolts, or other supports), or to some other structure such as side or interior walls of the vacuum plenum 625.

As shown in FIGS. 6A-7B, the linear actuator 652 is coupled to the damper 651 by a linkage comprising a piston 653 an arm 654. The linear actuator 652 moves the piston 653 linearly, and this linear motion of the piston 653 is translated into linear motion of the damper 651 along a cross-process direction. The linear actuator 652 is an embodiment of the actuator 659 described above in relation to FIG. 2. Any device capable of generating linear motion of the piston 653 may be used as the linear actuator. For example, the linear actuator 652 may comprise a solenoid, a hydraulic actuator, a pneumatic actuator, an electrical motor coupled to a screw drive system or other rotary-to-linear mechanism, etc. The linear actuator 652 may be held stationary relative to the vacuum platen 626, such that moving the piston 653 results in motion of the damper 651 relative to the platen 626. For example, as shown in FIGS. 6A-6C, the linear actuator 652 may be secured to the vacuum platen 626 via supports 655. The supports 655 may comprise screws, bolts, or any other rigid supports, and may be integral with the platen 626 or secured to the platen 626 using mechanical fasteners, welding, adhesives, or any other fastening technique. In some embodiments, the linear actuator 652 may be secured to some other structure, such as a bottom, side, or interior wall of the vacuum plenum 625.

In FIGS. 6A-7B, the linear actuator 652 is positioned on an outboard side of the damper 651, coupled to the vacuum platen 626, and arranged with direction of motion of the piston 653 being parallel to the cross-process direction, but the position and configuration of the linear actuator 652 are not limited. In some embodiments, the linear actuator 652 is located on an inboard side of the damper 651. In some embodiments, the linear actuator 652 is coupled to some other part of the vacuum plenum 625, such as a bottom, side, or interior wall of the vacuum plenum 625. In some embodiments, the linear actuator 652 is arranged with the direction of motion of the piston 653 not being parallel to the cross-process direction—for example, the piston 653 may move in a vertical direction (z-axis direction), and this vertical motion of the piston 653 may be converted into horizontal motion of the damper 651 in the cross-process direction (x-axis direction) by a conversion mechanism such as rack-and-pinion mechanism, etc.

The linear actuator 652 is configured such that its presence does not block airflow through holes 627, so as to avoid inhibiting the hold down force on the print media 605. For example, when positioned under the holes 627, the linear actuator 652 may be positioned with a gap between it and the bottom surface of the vacuum platen 626 so that the linear actuator 652 does not block airflow through the holes 627, as in FIGS. 6A-6C. As another example, the linear actuator 652 may be positioned at a location in the plenum 625 where there are no holes 627, such as on an inboard side of the holes 627.

FIGS. 6A-7B illustrates the damper 651 being moved between different positions based on the size of the print media 605. In FIGS. 6A and 7A, a first print medium 605*a* is used, and the damper 651 is moved to a first position based on the size of the print medium 605*a* to block a first subset of holes 627 in the uncovered region 622. In FIG. 6B, a second print medium 605*b* is used which is wider than the first print medium 605*a*, and thus the uncovered region 622 is smaller than in FIGS. 6A and 7A. Therefore, the actuator 652 is controlled to move the damper 651 in the cross-process direction to a second position associated with the size of the second print medium 605*b* so as to block a second subset of the holes 627. Because the second print medium 605*b* is sized differently than the first print medium 605*a*, the second subset of holes 627 blocked by the damper 651 in the second position is different than the first subset of holes 627 blocked by the damper 651 in the second position. In FIGS. 6C and 7B, a third print medium 605*c* is used which has the largest width supported by the printing system, and thus the actuator 652 is controlled to move the damper 651 fully to the inboard side IB such that none of holes 627 are blocked.

Figure 8A:
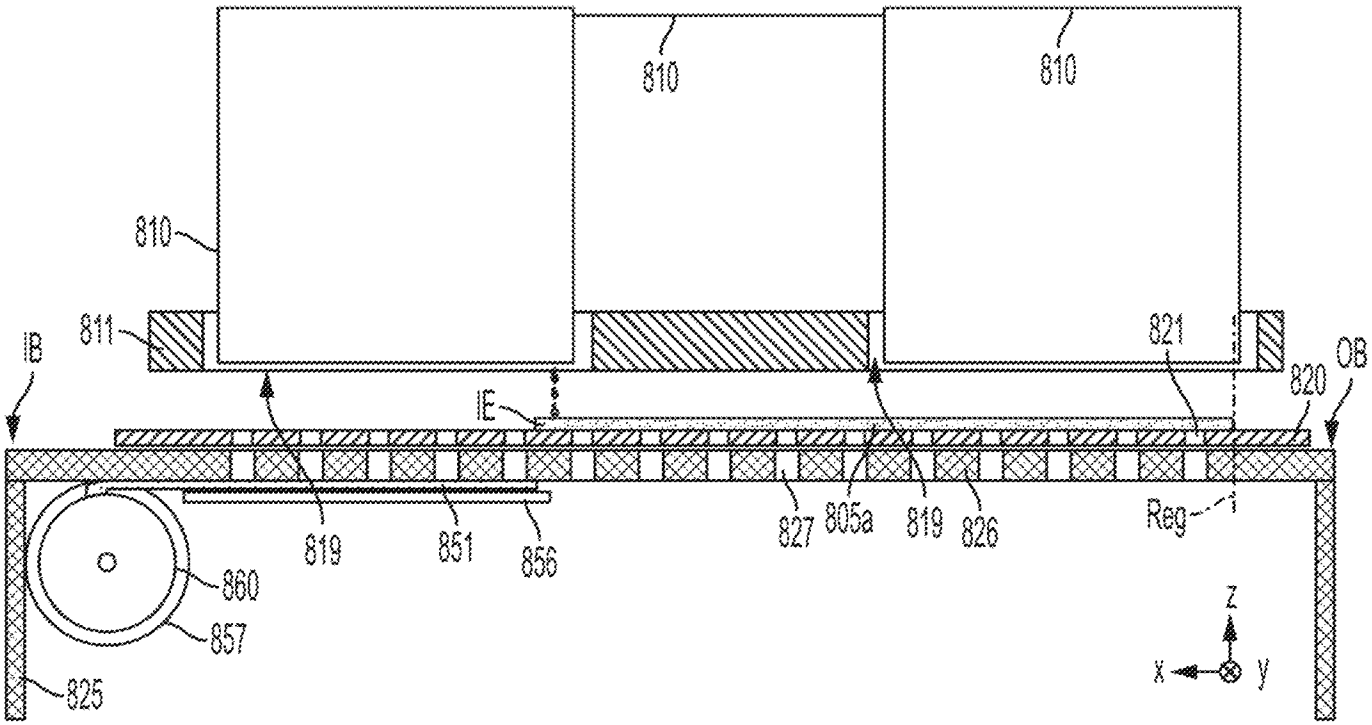
FIGS. 8A-8B are cross-sectional views of an embodiment of an inkjet printing system, with the cross-section taken along the line C-C in FIG. 4.
Figure 8B:
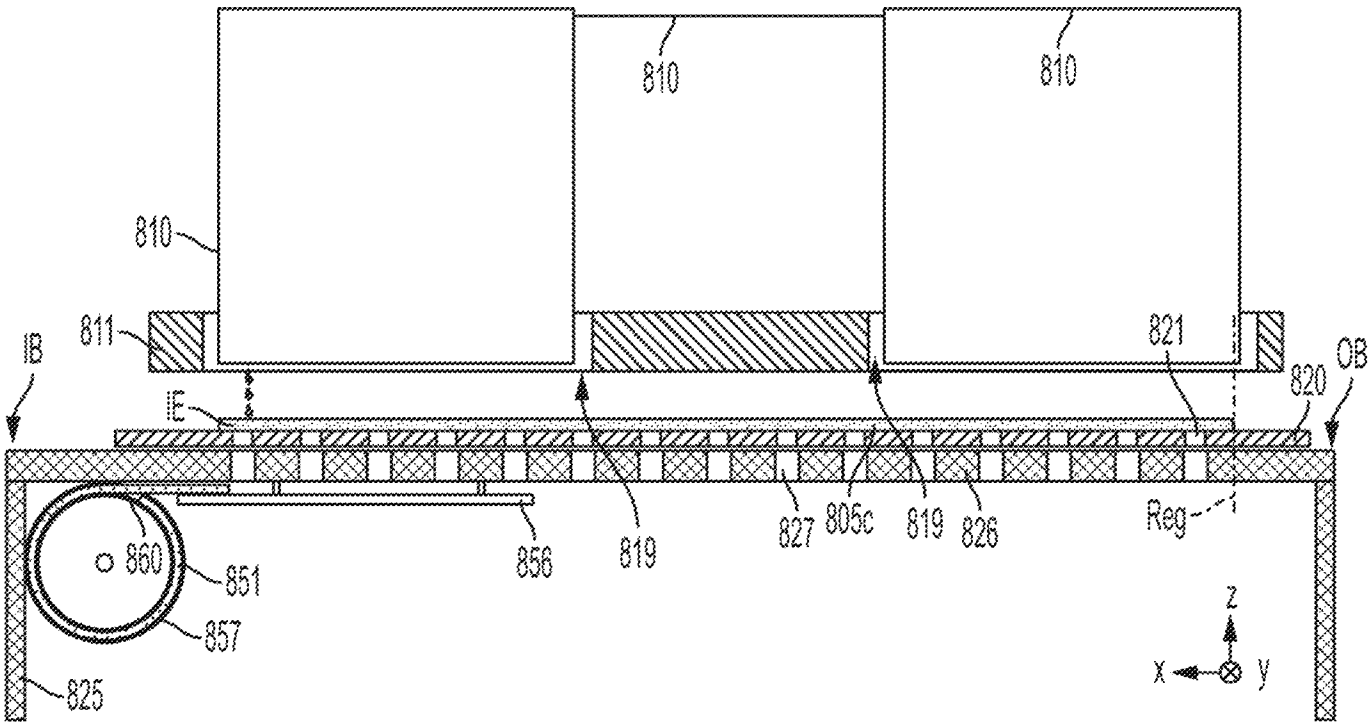
Figure 9A:
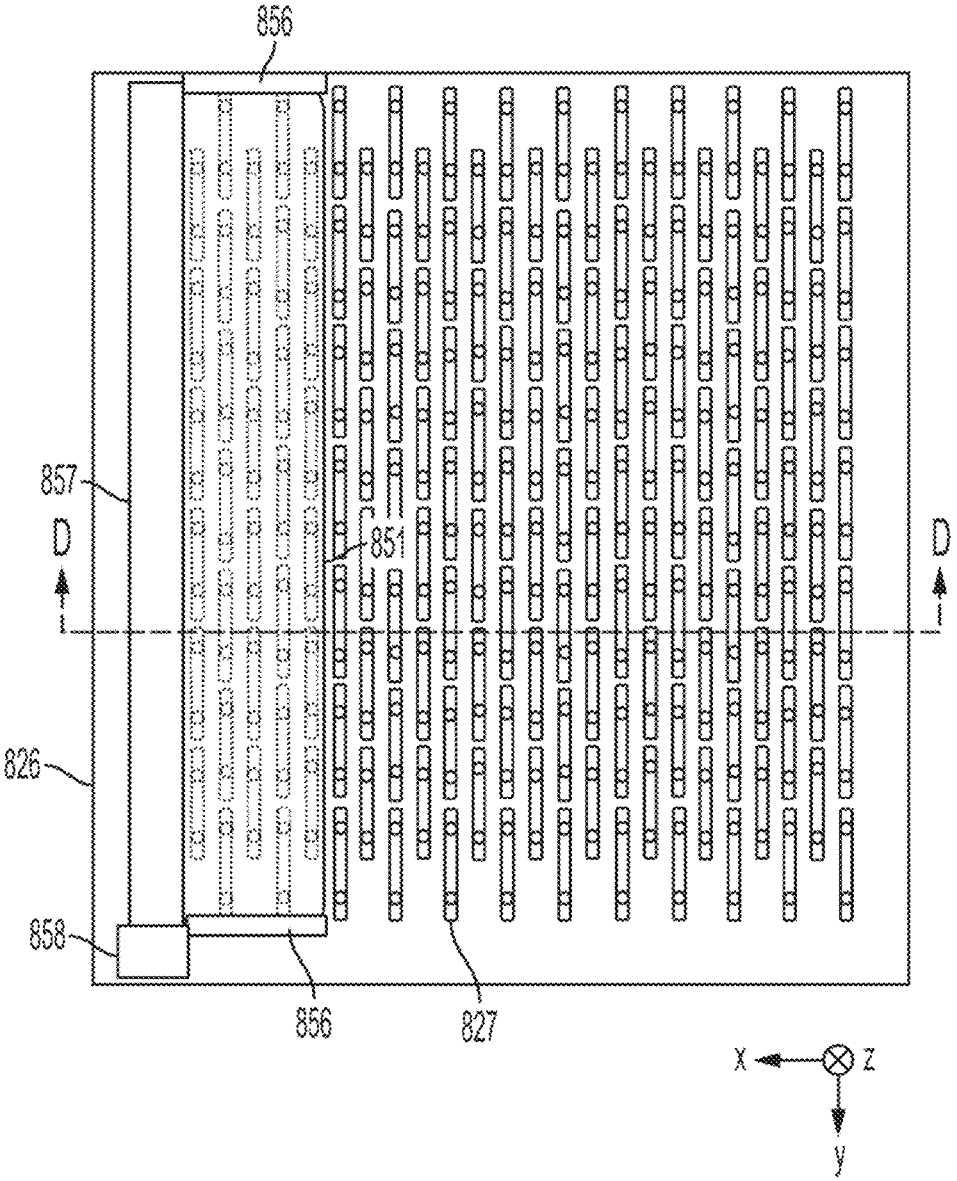
FIG. 9A-9B are plan views of the printing system of FIGS. 8A-8B from below a vacuum platen.
Figure 9B:
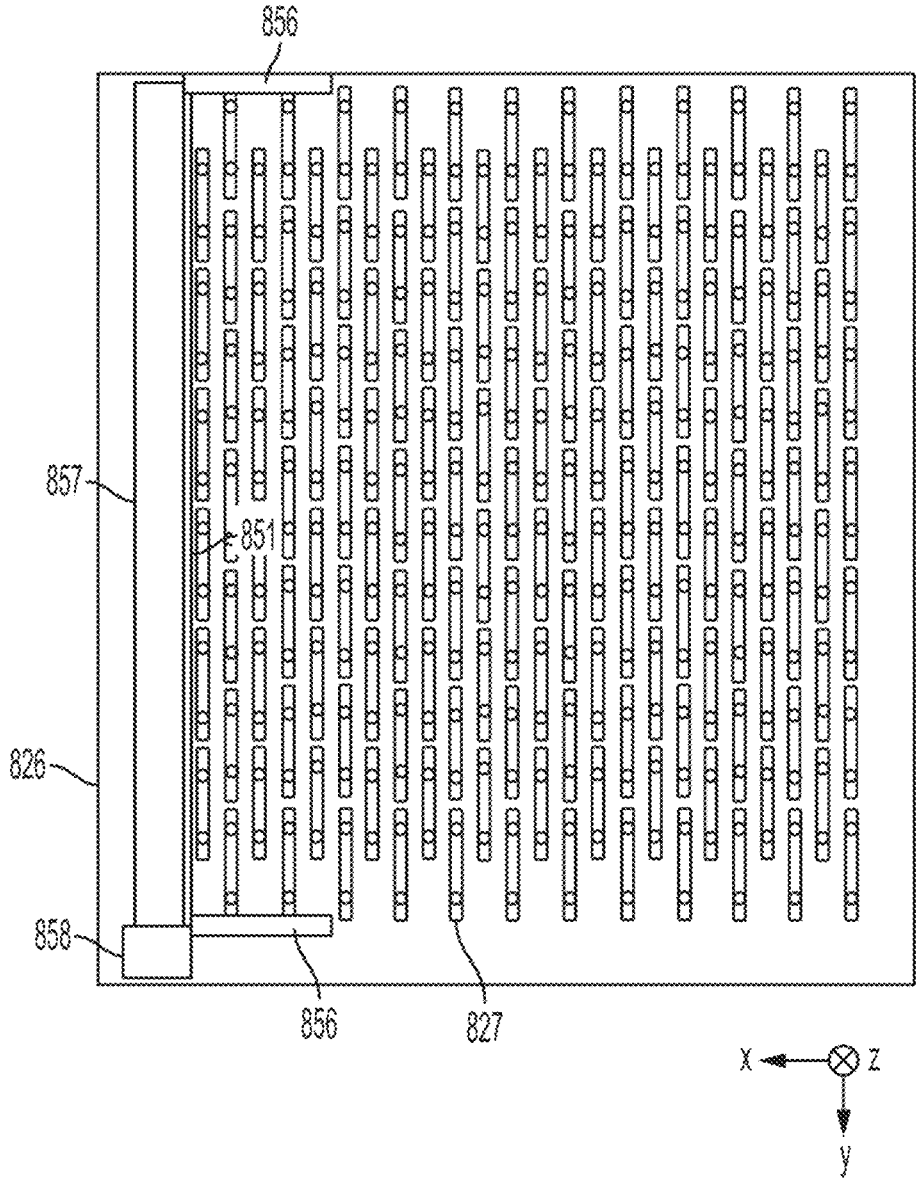

FIGS. 8A-9B illustrate an airflow control system 850, which can be used as the airflow control systems 150 or 350. FIGS. 8A and 8B comprise cross-sections taken along the line C in FIG. 4, with FIGS. 8A and 8B showing states in which the damper 151 is in different positions to accommodate different sizes of print media 105. FIGS. 9A and 9B comprise bottom-up plan views of the vacuum platen 126 and airflow control system 150, with FIGS. 9A and 9B showing the same states illustrated in FIGS. 8A and 8B, respectively. In FIGS. 8A-9B, some items that would not normally visible in the illustrated view, for example because they are under or behind another object, may be shown using dashed or dotted lines.

Similar to the airflow control system 650 described above, in the airflow control system 850 the damper 851 is positioned under the vacuum platen 826 towards an inboard side IB of the platen 826. However, in this embodiment the damper 851 is flexible in the cross-process direction to enable movement along a path containing a curved section, and movement of the damper 851 is driven by a rotatory actuator 857. For example, the damper 851 may comprise a flexible sheet, such as a flexible plastic sheet, spring steel, or other flexible metal. As another example, the damper 851 may comprise an assembly or chain of rigid segments coupled together which can move or flex relative to one another along a cross-process direction so that the assembly as a whole is rigid along a process direction but relatively flexible along a cross-process direction, like a garage door. As another example, the damper 851 may comprise a fabric.

As noted above, the rotary actuator 857 moves the damper 851 by rotation of a rotor. The rotary actuator 857 is an embodiment of the actuator 859 described above in relation to FIG. 2. In the embodiment illustrated in FIGS. 8A-9B, the rotor of the rotary actuator 857 comprises a hub 860, which rotates around a central axis. The rotary actuator 857 also comprises a motor 858, which drives rotation of the rotor. The damper 851 is coupled to the rotor such that rotation of the rotor is converted into translation of the outboard end of the damper 851 along a straight path along the bottom of the platen 826. For example, the damper 851 may be supported and guided by rails 856, similar to the rails 856 described above in relation to FIGS. 6A-7B, which constrain the outboard end of the damper 851 to move along a straight path. In addition, in this embodiment the path along which the damper 851 moves also comprises a curved section, in which the damper 851 is bent/flexed.

For example, as illustrated in FIGS. 8A and 8B, the rotary actuator 857 may comprise a hub 860 and the damper 851 may be wound around a curved outward surface of the hub 860. In such an embodiment, the inboard end portion of the damper 851 is coupled to the hub 860, either directly or indirectly through a linkage, and the outboard end portion of the damper 851 is engaged with the rails 856. Thus, when the hub 860 is rotated by the motor 858, a portion of the damper 851 is curved or flexed to wind onto the hub 860 and a portion of the damper 851 is translated along the rails 856 following a straight path. In other words, the hub 860 and the rails 856 cooperate to convert rotational motion of the rotary actuator 857 into translation of the outboard end of the damper 851. FIGS. 8A and 9A show a state in which the damper 851 is extended towards the outboard side and little or none of the damper 851 is wound onto the hub 860. FIGS. 8B and 9B show a state in which the damper 851 is retracted towards the inboard side and a majority of the damper 851 is wound around the hub 860. In another embodiment, the outboard end of the damper 851 may be coupled to a separate actuate (e.g., linear actuator) which pulls or pushes the outboard end of the damper 851 across the platen 826. For example, if the damper 851 is fabric, the outboard end may be coupled to the actuator by a clamp fixed to the actuator, and the hub 860 may be couple to a brake such that, when actuated, the outboard end of the fabric is pulled across the platen in an outboard direction and the roll is allowed to move while keeping tension on the fabric.

The motor 858 may comprise any device capable of generating rotary motion of the rotor (hub 860). For example, the motor 858 may comprise an electric motor, a hydraulic rotary actuator, a pneumatic rotary actuator, a linear actuator coupled to a linear-to-rotary conversion mechanism, etc. The rotary actuator 857 may be held stationary relative to the vacuum platen 826, for example by supports or other fasteners. The rotary actuator 857 may be configured such that its presence does not unduly inhibit the hold down force on the print media 805 near the printheads. For example, as illustrated in FIGS. 8A-9B, the rotary actuator 857 may be positioned at a location where there are no holes 827.

FIGS. 8A-9B illustrate the damper 851 being moved between different positions based on the size of the print media 805. In FIGS. 8A and 9A, a first print medium 805*a* is used, and the damper 851 is moved to a first position based on the size of the print medium 805*a* to block a first subset of holes 827. In FIG. 8B, a second print medium 805*c* is used which is wider than the first print medium 805*a*, and thus the actuator 852 is controlled to move the damper 851 in the cross-process direction to a second position associated with the size of the print medium 805*c* in which none of the holes 827 are blocked.

Figure 10:
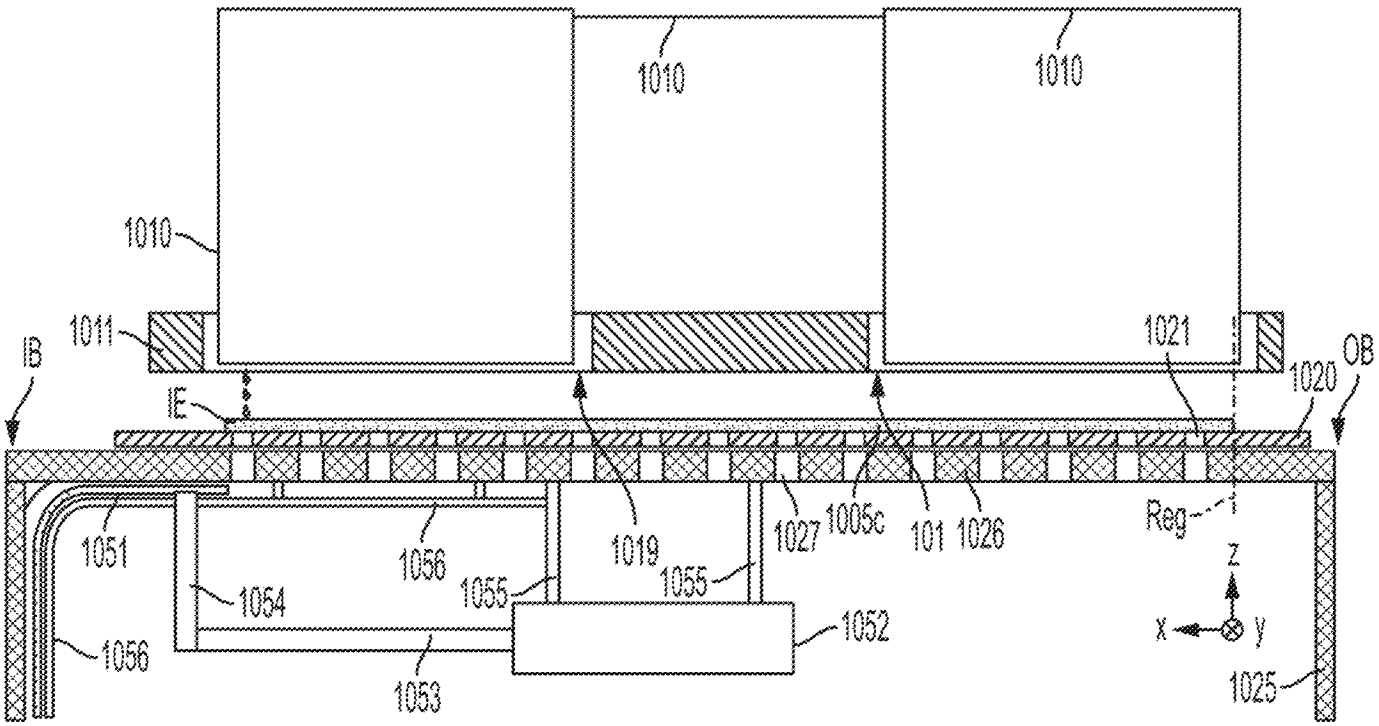
FIG. 10 is a cross-sectional view of an embodiment of an inkjet printing system, with the cross-section taken along the line C-C in FIG. 4.

FIG. 10 illustrates an airflow control system 1050, which can be used as the airflow control systems 150 or 350. FIG. 10 comprise cross-sections taken along the line C in FIG. 4, and illustrates a states in which the damper 151 is in a fully undeployed position.

Similar to the airflow control system 850 described above, in the airflow control system 1050 the damper 1051 is positioned under the vacuum platen 1026 towards an inboard side IB of the platen 1026 and is flexible in the cross-process direction to enable movement along a path containing a curved section. Thus, the damper 1051 may be flexible along the cross-process direction similar to the damper 851. However, in the airflow control system 1050, instead of winding around a hub, in the undeployed position an end of the damper 1051 is redirected to extend along a different direction than the cross-process direction, such as vertically along a side wall of the vacuum plenum 1025 as illustrated in FIG. 10. Thus, as the damper 1051 moves between the undeployed and deployed positions, one end of the damper 1051 will move horizontally along a horizontal portion of the track 1056 while the other end of the damper 1051 will move vertically along a vertical portion of the track 1056, with the damper 1051 bending as it passes through a curved portion of the track 1056 which couples the horizontal and vertical portions of the track 1056.

As shown in FIG. 10, the actuator 1052 is coupled to the damper 1051 by a linkage comprising a piston 1053 an arm 1054, similar to the actuator 652. The actuator 1052 moves the piston 1053 linearly, and this linear motion of the piston 1053 is translated into linear motion of an end of the damper 1051 along a cross-process direction. The actuator 1052 is an embodiment of the actuator 159 described above in relation to FIG. 2. Any device capable of generating linear motion of the piston 1053 may be used as the linear actuator. For example, the linear actuator 1052 may comprise a solenoid, a hydraulic actuator, a pneumatic actuator, an electrical motor coupled to a screw drive system or other rotary-to-linear mechanism, etc. The linear actuator 1052 may be held stationary relative to the vacuum platen 1026, such that moving the piston 1053 results in motion of the damper 1051 relative to the platen 1026. For example, as shown in FIG. 10, the linear actuator 1052 is secured to the vacuum platen 1026 via supports 1055. The supports 1055 may comprise screws, bolts, or any other rigid supports, and may be integral with the platen 1026 or secured to the platen 1026 using mechanical fasteners, welding, adhesives, or any other fastening technique. In some embodiments, the actuator 1052 may be secured to some other structure, such as a bottom, side, or interior wall of the vacuum plenum 1025.

In FIG. 10, the actuator 1052 drives movement of the damper 1051 by moving the arm 1054 horizontally, but in other embodiments the actuator 1052 may move the arm 1054 differently. For example, in an embodiment the actuator 1052 is coupled to the opposite end of the damper 1051 than is illustrated in FIG. 10, and drives movement of the damper 1051 through vertical motion of the arm 1054.

Although the embodiments of the airflow control system described above are illustrated and described in the context of the specific printing assemblies and media transport devices, the same airflow control systems could be used in other the printing systems having with differently configured printing assemblies and media transport devices. For example, the various embodiments of the airflow control systems could be used in printing systems with different types of moving support surfaces, printing systems with different types of vacuum plenums, printing systems with different types of vacuum platens, printing systems with different numbers and/or types of printhead modules, and so on.

In the description above, it is assumed for the sake of convenience that the printing system registers the print media such that an outboard edge OE of the print media is aligned with a registration location Reg near an the outboard side OB of the media transport device. As a result, the uncovered region is located on the inboard side of the print media, and therefore the damper is also located on an inboard side. However, it should be understood that the printing system could instead register the print media to some other location, in which case uncovered region may appear elsewhere and the damper may be repositioned accordingly so that it is located proximate to the uncovered regions. For example, if the printing system registers the inboard edge IE of the print media to a registration location on an inboard side IB of the media transport device, then the uncovered region would appear on the outboard side of the platen and the damper could be located in that region. As another example, if the printing system registers the middle of the print media to a location near a middle of the media transport device, then uncovered regions would appear on both the inboard and outboard sides of the print media, in which case two sets of airflow control systems may be provided, one to block the uncovered regions on the inboard side and one to block the uncovered regions on the outboard side.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding embodiments of the invention but is not intended to limit the invention. For example, spatially terms—such as "upstream", "downstream", "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the moving support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the damper is movable in a cross-process direction" means that the damper can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the moving support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the moving support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the moving support surface in the deposition region (or tangent to the moving support surface in the deposition region, if the moving support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

What is claimed is:

1. A printing system, comprising:

an ink deposition assembly comprising one or more printheads arranged to eject a print fluid to a deposition region of the ink deposition assembly;

a media transport device comprising a movable support surface, the media transport device configured to hold a print medium against the movable support surface by vacuum suction through holes in the media transport device and transport the print medium along a process direction though the deposition region;

an airflow control system comprising:

a damper that is moveable in a cross-process direction perpendicular to the process direction, the damper arranged to block airflow through a subset of the holes, the subset varying based on a position of the damper; and an actuator operably coupled to the damper and configured to move the damper; and a controller configured to cause the actuator to selectively move the damper to change the subset of the holes blocked by the damper based on a size of the print medium wherein the controller is configured to cause the actuator to move the damper between a first position and a second position, the first position associated with a first size of the print medium and the second position associated with a second size of the print medium.

2. The printing system of claim 1, wherein, in the first position the damper blocks airflow through a first subset of the holes and in the second position the damper blocks airflow through a second subset of the holes.

3. The printing system of claim 1, wherein, in the first position the damper blocks airflow through a first subset of the holes and in the second position the damper does not block airflow through any of the holes.

4. The printing system of claim 1, wherein the damper comprises a rigid plate, and the actuator comprises a linear actuator configured to move the rigid plate along the cross-process direction.

5. The printing system of claim 4, wherein the linear actuator is configured to move a piston linearly, and the piston is coupled to the damper such that linear motion of the piston drives linear motion of the damper along the cross-process direction.

6. The printing system of claim 1, wherein the damper is flexible along the cross-process direction, and the damper is constrained to move along a path such that as a first end of the damper moves along the cross-process direction a portion of the damper moves along a curved portion of the path.

7. The printing system of claim 6, wherein the actuator comprises a rotary actuator configured to move a second end of the damper along the curved portion of the path.

8. The printing system of claim 7, wherein the rotary actuator is configured to rotate a hub, the second end of the damper is coupled to the hub such that rotation of the hub winds a portion of the damper around the hub and causes the first end of the damper to move along the cross-process direction.

9. The printing system of claim 1, wherein the holes are arranged in columns extending along a process direction, and wherein the controller is configured to cause the actuator to move the damper such that the subset of holes blocked by the damper comprises holes in each column that is not covered by the print media during transport of the print medium through the deposition region and does not include any holes in any columns that are covered by the print medium during transport of the print medium through the deposition region.

10. The printing system of claim 1, wherein the media transport device comprises a vacuum platen comprising the holes, the moving support surface comprises a belt configured to slide over a top surface of the vacuum platen, and the damper is adjacent a bottom surface of the vacuum platen to block the subset of holes in the vacuum platen.

11. A method, comprising:

transporting a print medium along a process direction through a deposition region of a printhead of a printing system, wherein the print medium is held during the transporting against a moving support surface of a media transport device via vacuum suction through holes in the media transport device;

ejecting print fluid from the printhead to deposit the print fluid to the print medium in the deposition region; and controlling an airflow control system to selectively block a subset of the holes by moving a damper along a cross-process direction perpendicular to the process direction, the subset of the holes varying based on a position of the damper, wherein selectively blocking the subset of the holes comprises selectively moving the damper to change the subset of the holes blocked by the damper based on a size of the print medium, wherein moving the damper in the cross-process direction comprises causing a linear actuator to move the damper linearly in the cross-process direction moving the actuator between a first position and a second position, the first position associated with a first size of the print medium and the second position associated with a second size of the print medium.

12. The method of claim 11, wherein the print medium is a first print medium having a first size; and selectively blocking the subset of the holes comprises moving the damper to the first position associated with the first size in response to the first print medium being selected for printing.

13. The method of claim 12, the method further comprises:

transporting a second print medium through the deposition region, the second print medium having the second size; and controlling the airflow control system to selectively block the subset of the holes by moving the damper to the second position associated with the second size in response to the second print medium being selected for printing.

14. The method of claim 13, wherein, in the first position the damper blocks a first subset of the holes and in the second position the damper blocks a second subset of the holes.

15. The method of claim 13, wherein, in the first position the damper blocks a first subset of the holes and in the second position the damper does not block any of the holes.

16. The method of claim 11, wherein moving the damper in the cross-process direction comprises causing a linear actuator to move the damper linearly in the cross-process direction.

17. The method of claim 11, wherein the holes are arranged in columns extending along a process direction, and selectively blocking the subset of the holes comprises moving the damper such that the subset of holes blocked by the damper comprises holes in each column that is not covered by the print medium during transport of the print medium through the deposition region and does not comprise holes in any columns that are covered by the print medium during transport of the print medium through the deposition region.

18. A method, comprising:

transporting a print medium along a process direction through a deposition region of a printhead of a printing system, wherein the print medium is held during the transporting against a moving support surface of a media transport device via vacuum suction through holes in the media transport device;

ejecting print fluid from the printhead to deposit the print fluid to the print medium in the deposition region; and controlling an airflow control system to selectively block a subset of the holes by moving a damper along a cross-process direction perpendicular to the process direction, the subset of the holes varying based on a position of the damper, wherein selectively blocking the subset of the holes comprises selectively moving the damper to change the subset of the holes blocked by the damper based on a size of the print medium, wherein moving the damper in the cross-process direction comprises moving a first end of the damper linearly in the cross-process direction by causing a second end of the damper to move along a path comprising a curved portion.

19. The method of claim 18, wherein causing the second end of the damper to move along the path comprises rotating a hub attached to the second end of the damper and thereby winding a portion of the damper around the hub.

20. The method of claim 18, wherein the holes are arranged in columns extending along a process direction, and selectively blocking the subset of the holes comprises moving the damper such that the subset of holes blocked by the damper comprises holes in each column that is not covered by the print medium during transport of the print medium through the deposition region and does not comprise holes in any columns that are covered by the print medium during transport of the print medium through the deposition region.

* * * * *